US007631876B1

(12) United States Patent
Walterscheid

(10) Patent No.: US 7,631,876 B1
(45) Date of Patent: Dec. 15, 2009

(54) MAGNETIC PROJECTILE AND TARGET GAME THAT USES A FULCRUM BOARD LAUNCHER

(76) Inventor: Steve Walterscheid, P.O. Box 7409, Bend, OR (US) 97708

( * ) Notice: Subject to any disclaimer, the term of this patent is extended or adjusted under 35 U.S.C. 154(b) by 0 days.

(21) Appl. No.: 11/906,333

(22) Filed: Oct. 2, 2007

Related U.S. Application Data

(63) Continuation-in-part of application No. 11/442,681, filed on May 25, 2006.

(60) Provisional application No. 60/773,790, filed on Feb. 14, 2006.

(51) Int. Cl.
*A63B 63/00* (2006.01)
*A63B 67/12* (2006.01)
*F41J 3/00* (2006.01)

(52) U.S. Cl. ..... 273/348.3; 273/341.1; 124/4

(58) Field of Classification Search ..... 273/340, 273/341.1, 355–357, 405, 129 S, 129 T, 129 V, 273/129 W, 353; 124/4
See application file for complete search history.

(56) References Cited

U.S. PATENT DOCUMENTS 310,388 A * 1/1885 Dealy ..... 273/355
614,094 A * 11/1898 Farnum ..... 273/399
1,535,035 A * 4/1925 Philipp ..... 446/92
2,279,857 A * 4/1942 Bodnar ..... 124/4
2,645,490 A * 7/1953 Volman ..... 473/505
3,208,444 A * 9/1965 Sipos ..... 124/4
3,381,962 A * 5/1968 Leigh ..... 273/348.3
3,425,694 A * 2/1969 Norris ..... 273/399
5,265,885 A * 11/1993 Blount ..... 273/348.3
5,438,972 A * 8/1995 Harbin ..... 124/27
6,517,075 B1 * 2/2003 Yoon ..... 273/348.3
2007/0170654 A1 * 7/2007 Stoddart ..... 273/348.3

* cited by examiner

*Primary Examiner*—Mark S Graham
(74) *Attorney, Agent, or Firm*—LaMorte & Associates

(57) ABSTRACT

A dart projectile game and its associated method of play. A launcher is provided that has a base and a lever suspended above the base by a fulcrum connection. The lever has a first end and an opposite second end that can teeter up and down. Magnetic material is coupled to the base below the first end of the lever. A projectile is provided that contains a magnet tip. Furthermore, a target is provided that has at least one magnetic section. The projectile is placed on the first end of the lever, wherein the magnet in the projectile attracts the magnetic material under the first end of the lever and biases the first end of the lever downwardly. A person presses down on the second end of the lever with enough force to overcome the magnetic attraction and accelerate the projectile into flight toward the target.

7 Claims, 3 Drawing Sheets

MAGNETIC PROJECTILE AND TARGET GAME THAT USES A FULCRUM BOARD LAUNCHER

RELATED APPLICATIONS

This application is a continuation-in-part of copending U.S. patent application Ser. No. 11/442,681, entitled Magnetic Acrobat Game, and filed May 25, 2006, which claims priority of Provisional Patent Application No. 60/773,790, filed Feb. 14, 2006.

BACKGROUND OF THE INVENTION

1. Field of the Invention

In general, the present invention relates to target games that use magnetic tipped projectiles that magnetically attach to a target. The present invention also relates to projectile launchers that use fulcrum levers to propel a projectile into flight.

2. Prior Art Description

The prior art is replete with games that use dart projectiles of various configurations. Dart games for adults tend to use darts with pointed tips. However, for safety's sake, games marketed to children use safe-tip darts. Safe-tip darts come in many styles. One of the more popular safe-tip dart designs has a blunt magnetic tip. Darts with magnetic tips are tossed at magnetic targets. The magnet at the tip of the dart adheres to the target with magnetic attraction. The use of magnetic tipped darts is becoming increasingly popular due to the recent commercial availability of low cost, high strength rare earth magnets.

Many prior art dart games use magnetic tipped darts, and often the darts are manually thrown at the target in the traditional manner. The magnetic tip of the dart, therefore, has no effect upon the manner in which the dart is propelled. The present invention game is unique in that it utilizes a novel launching mechanism that can only be used with darts that have high strength magnetic tips. The launching mechanism adds a degree of skill and novelty to dart games that has not previously existed. The details of the present invention dart game with its launching mechanism are described and claimed below.

SUMMARY OF THE INVENTION

The present invention is a dart projectile game and its associated method of play. To play the game, a launcher is provided that has a base and a lever suspended above the base by a fulcrum connection. The lever has a first end and an opposite second end that can teeter up and down. Magnetic material is coupled to the base below the first end of the lever.

A projectile is provided that contains a magnet tip. Furthermore, a target is provided that has at least one magnetic section. The projectile is placed on the first end of the lever, wherein the magnet in the projectile attracts the magnetic material under the first end of the lever and biases the first end of the lever downwardly.

A person presses down on the second end of the lever with enough force to overcome the magnetic attraction and accelerate the projectile into flight toward the target. The projectile magnetically attaches to the target if the projectile lands upon the target.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention game can use projectiles of various shapes, it is particularly well suited for using projectiles of a dart shape. Accordingly, the exemplary embodiment of the present invention shows the use of dart-shaped projectiles in order to set forth the best mode contemplated for the invention. However, it will be understood that the selection of a dart-shaped projectile is merely exemplary and that it should not be considered a limitation.

Figure 1:
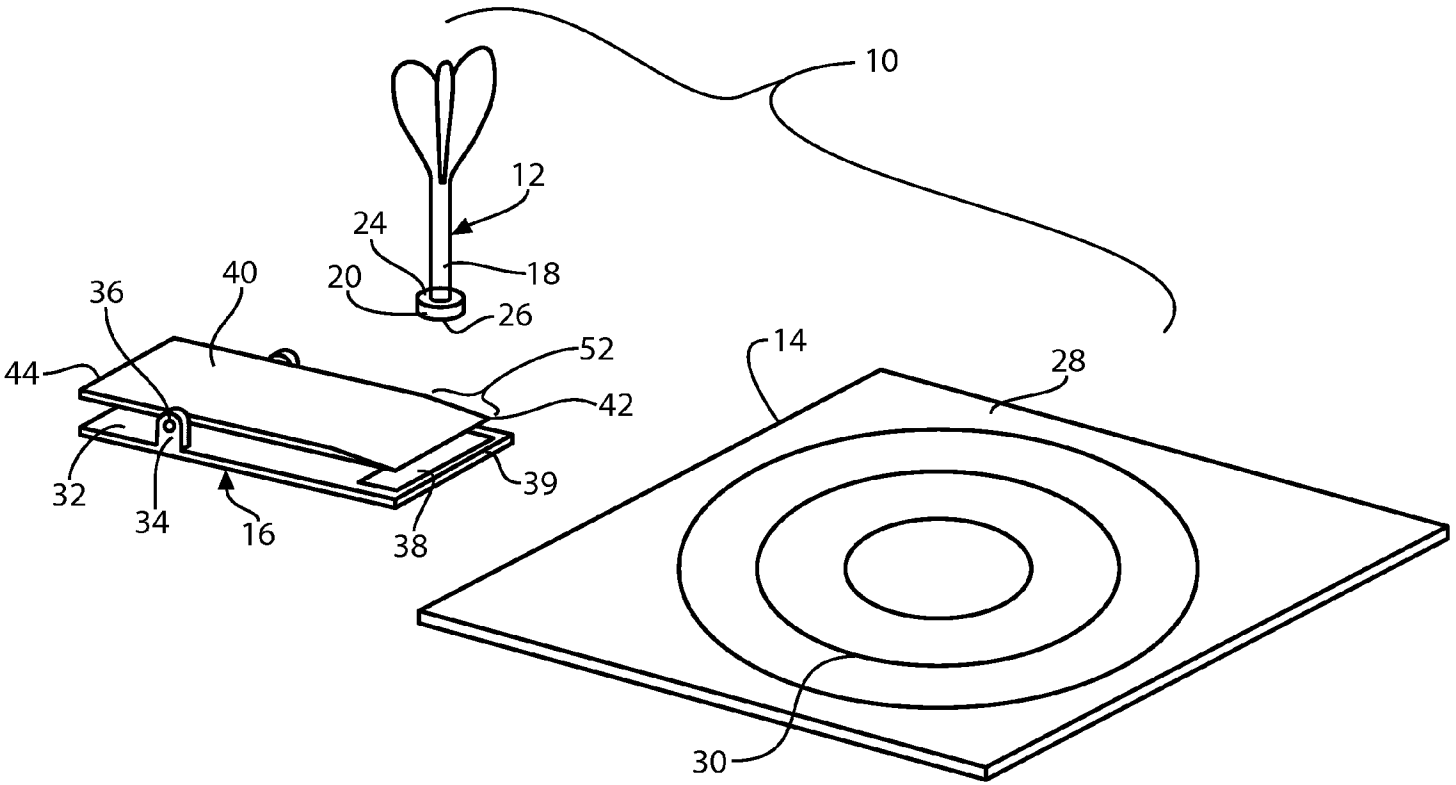
FIG. 1 is a perspective view of an exemplary embodiment of a projectile game.

Referring to FIG. 1, the present invention game assembly 10 is shown. The game assembly 10 includes a plurality of projectiles 12, a target board 14, and a launcher 16. The projectiles 12 illustrated are magnetic tipped darts 18. In the forward tip 24 of each dart 18 is a high strength rare earth magnet 20. Fletching 22 is present on the rear of each dart 18. The forward tip 24 of the dart 18 is heavier than the rear of the dart 18. This, in addition to the fletching 22, causes the dart 18 to fly with its forward tip 24 leading as it passes through the air.

The magnet 20 in the forward tip 24 of each dart 18 presents that dart with a flat front surface 26. The flat front surface 26 is preferably large enough so that the dart 18 can stand freely upon the flat front surface 26 when placed upon the flat front surface 26 or landing upon its flat front surface 26.

The target board 14 has a top surface 28 that is made of a ferro-magnetic material, such as sheet steel. Target indicia 30 can be printed upon the target board 14. The indicia 30 is a matter of design choice. In the shown embodiment, a traditional bullseye target pattern is illustrated.

Figure 2:
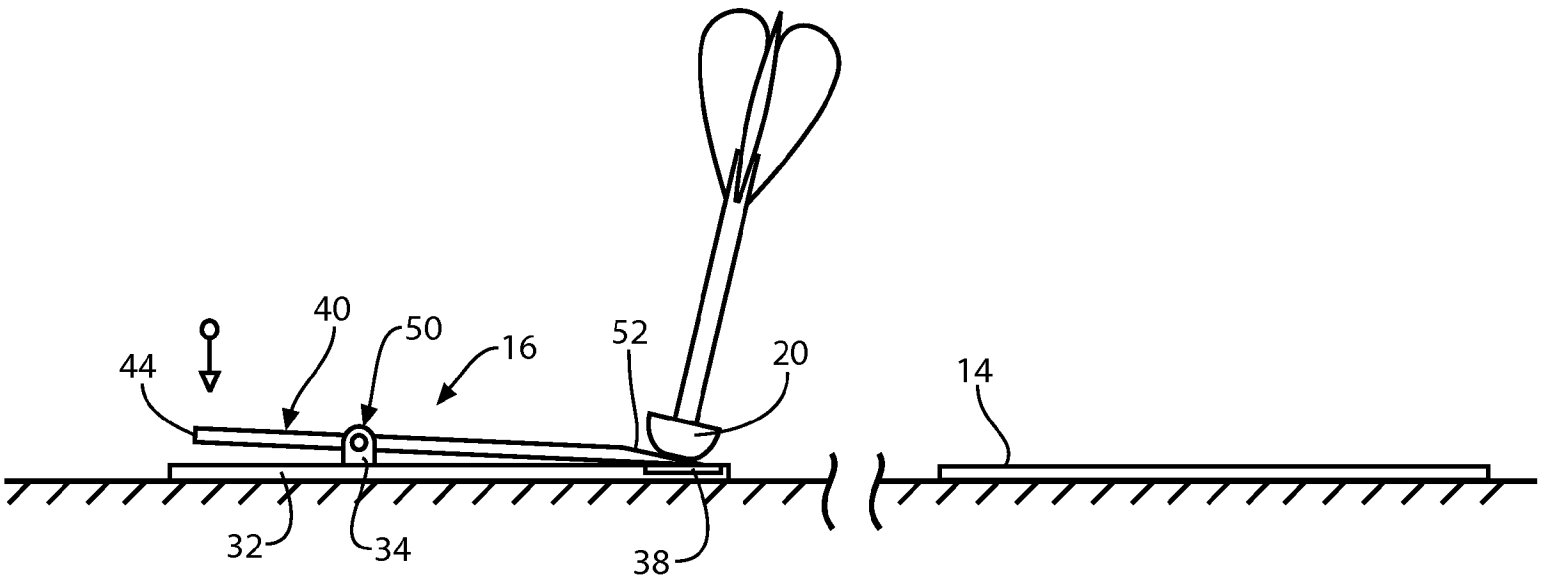
FIG. 2 is a side view of the embodiment of FIG. 1, with a projectile shown in a launching position.

Referring to FIG. 2 in conjunction with FIG. 1, it can be seen that the launcher 16 has a flat base 32. Two yoke projections 34 extend upwardly from the flat base 32. Each of the yoke projections 34 defines a hole 36.

A piece of magnetic materiel 38 is attached to the flat base 32 proximate its forward end 39. In the shown embodiment, the magnetic material 38 is a strip of sheet metal. The piece of magnetic material 38 is mechanically and/or adhesively connected to the launcher base 32 so that it cannot be pulled away from the launcher base 32.

A lever arm 40 is provided. The lever arm 40 has a forward end 42 and a rearward end 44. Two opposing pivot pins 46 extend out of opposite sides of the lever arm 40. The pivot pins 46 are sized to fit inside the holes 36 of the yoke projections 34 that extend up from the launcher base 32. When the pivot pins 46 engage the holes 36 in the yoke projections 34, a fulcrum joint 50 is created. The lever arm 40 is free to teeter about the fulcrum joint 50 with the rearward end 44 of the lever arm 40 either raising or falling in opposition to the falling or rising of the forward end 42 of the lever arm 40.

The fulcrum joint 50 is located approximately one third of length of the lever arm 40 from its rearward end 44. It will therefore be understood that the distance between the fulcrum joint 50 and the forward end 42 of the lever arm 40 is approximately twice as long as the distance between the fulcrum joint 50 and its rearward end 44.

The lever arm 40 has a tapered section 52 proximate its forward end 42. As such, it will be understood that the material of the lever arm 40 thins in the tapered section 52. When the lever arm 40 is tilted, the tapered section 52 contacts the launcher base 32 directly above the segment of magnetic material 38.

Figure 3:
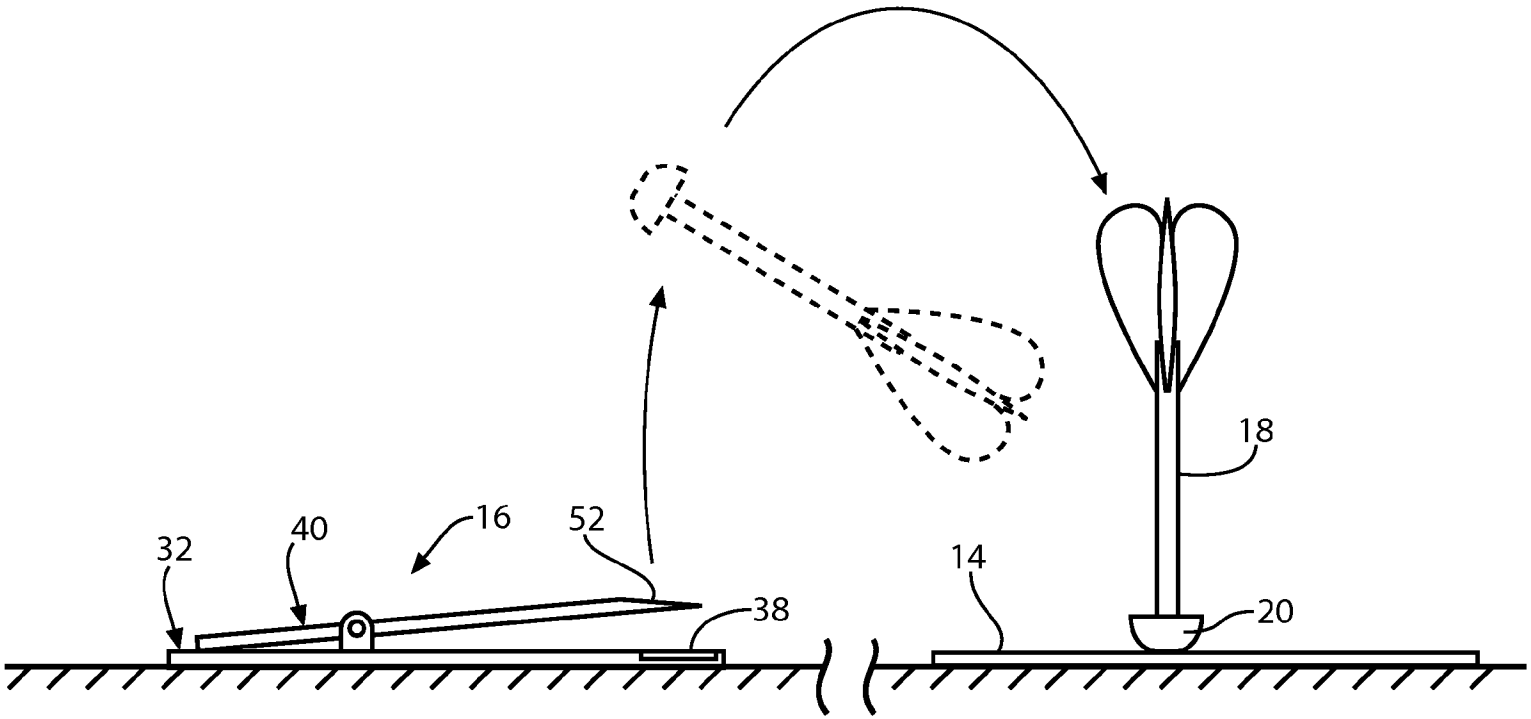
FIG. 3 is a side view of the embodiment of FIG. 1, with a projectile shown having landed on a target.

Referring to FIG. 3 in conjunction with FIG. 2, it can be seen that to use the launcher 16, the lever arm 40 is tilted down so that the tapered section 52 touches the launcher base 32 above the magnetic material 38. The projectile dart 18 is placed upon the tapered section 52 of the lever arm 40 with the magnet 20 facing down. The magnetic field created by the magnet 20 attracts the magnetic material 38 through the tapered section 52 of the lever arm 40. This biases the projectile dart 18 downward toward the magnetic material 38.

Due to the angle of the tapered section 52 of the lever arm 40, the projectile dart 18 does not stand in the vertical. Rather, the projectile dart 18 leans forward between ten and thirty degrees out of vertical.

The target board 14 is placed in front of the launcher 16. A user then presses down on the elevated rearward end 44 of the lever arm 40. As force is applied to the rearward end 44 of the lever arm 40, the force is resisted by the weight of the projectile dart 18, the weight of the large side of the lever arm 40 and the force that the magnet 20 in the projectile 12 exerts upon the underlying magnetic material 38. As the force applied to the rearward end 44 of the lever arm 40 increases, energy is stored in the lever arm 40 like a spring. Once the energy builds to a point where it can overcome the weight differentials and the magnetic connection, the lever arm 40 begins to teeter, therein raising the projectile dart 18. As the projectile dart 18 is raised, the magnet 20 moves away from the magnetic material 38. The magnetic interaction between the magnet 20 and the magnetic material 38 quickly diminishes and starts a chain reaction. The energy stored in the lever arm 40 is released in an instant and the forward end 42 of the lever arm 40 flies upward. This accelerates the projectile dart 18 and launches the projectile dart 18 into the air.

Once the projectile dart 18 is airborne, it corrects itself to fly magnet first. The projectile dart 18 flies toward the target board 14 and hopefully lands upon the target board 14. The target board 14 is made in part of magnetic material 38. As such, the projectile dart 18 magnetically connects to the target board 14 once it lands upon the target board 14. The placement of the projectile dart 18 on the target board 14 corresponds to the skill of a user in pressing the lever arm 40 and launching the projectile dart 18 into the air.

It will be understood that the embodiment of the present invention that is illustrated and described is merely exemplary. The projectiles can have many shapes other than that of darts. Likewise, the target can have many shapes other than a flat bullseye. For instance, the projectiles can be monkeys and the target can be a toy skyscraper. All such variations, modifications and alternate embodiments are intended to be included within the scope of the present invention as defined by the claims.

What is claimed is:

1. A method of play, comprising the steps of:

providing a launcher having a base and a lever suspended above said base by a fulcrum connection, wherein said lever has a first end and an opposite second end that can teeter up and down, and wherein magnetic material is coupled to said base below said first end of said lever;

providing a projectile that contains a magnet;

providing a target having at least one magnetic section;

placing said projectile on said first end of said lever, wherein said magnet in said projectile attracts said magnetic material and biases said first end of said lever downwardly;

pressing down on said second end of said lever with enough force to lift said first end of said lever and said projectile and accelerate said projectile into flight toward said target, wherein said projectile magnetically attaches to said target if said projectile lands upon said target.

2. The method according to claim 1, wherein said step of providing a projectile that contains a magnet further includes providing a projectile with a magnet at a first end and fletching at an opposite second end so that said projectile flies magnet first when propelled through the air.

3. The method according to claim 1, wherein said lever has a tapered surface at its first end, and wherein said step of placing said projectile on said first end of said lever includes placing said projectile on said tapered surface, therein causing said projectile to lean toward said target.

4. A game assembly, comprising:

a launcher having a base and a lever suspended above said base by a fulcrum connection, wherein said lever has a first end and an opposite second end that can teeter up and down;

magnetic material coupled to said base below said first end of said lever;

a projectile that contains a magnet, wherein said projectile is configured to stand freely upon said first end of said lever;

a target having at least one magnetic section.

5. The assembly according to claim 4, wherein said first end of said lever is angled, therein causing said projectile to lean at an angle when resting upon said first end of said lever.

6. The assembly according to claim 4, wherein said lever is longer between said first end and said fulcrum connection than it is between said second end and said fulcrum connection.

7. The assembly according to claim 4, wherein said projectile has a magnet at a first end and fletching at an opposite second end so that said projectile flies magnet first when propelled through the air.

* * * * *